United States Patent [19]

Mouissie

[11] Patent Number: 4,983,935

[45] Date of Patent: Jan. 8, 1991

[54] FIXING FRAME AND FILTER UNIT FOR CONNECTORS

[75] Inventor: Bob Mouissie, Berlicum, Netherlands

[73] Assignee: E. I. Du Pont de Nemours and Company, Wilmington, Del.

[21] Appl. No.: 406,803

[22] Filed: Sep. 12, 1989

[30] Foreign Application Priority Data

Sep. 13, 1988 [NL] Netherlands ..... 8802249

[51] Int. Cl.[5] ..... H01R 13/658

[52] U.S. Cl. ..... 333/184; 333/185; 439/608; 439/620

[58] Field of Search ..... 333/182–185; 439/608–610, 620, 607; 361/309, 302, 328, 330

[56] References Cited

U.S. PATENT DOCUMENTS

| | | | |
|---|---|---|---|
| 4,635,358 | 1/1987 | Fritz | 29/853 |
| 4,647,122 | 3/1987 | Kelly | 439/608 X |
| 4,682,129 | 7/1987 | Bakermans et al. | 333/184 |
| 4,711,026 | 12/1987 | Swiggett et al. | 29/850 |
| 4,720,915 | 1/1988 | Kennedy et al. | 29/847 |
| 4,722,022 | 1/1988 | Myers et al. | 439/620 X |
| 4,729,752 | 3/1988 | Dawson, Jr. et al. | 439/620 |
| 4,791,391 | 12/1988 | Linnell et al. | 333/184 |

FOREIGN PATENT DOCUMENTS 0299563 3/1989 European Pat. Off. .

*Primary Examiner*—Eugene R. LaRoche
*Assistant Examiner*—Seung Ham

[57] ABSTRACT

A fixing frame for a flat filter unit having a flat substrate with a pattern of passages for the contact elements of a connector. The fixing frame comprises a metal base plate having a pattern of passages corresponding to said filter unit, and being provided at two opposite edges with upright sides which each merge into guide grooves for accomodation between them of said flat filter unit. The fixing frame being provided with spring-loaded contact elements for contacting the housing or shielding of a connector.

12 Claims, 1 Drawing Sheet

FIXING FRAME AND FILTER UNIT FOR CONNECTORS

BACKGROUND OF THE INVENTION

The invention relates to filter connectors and in particular to a filter connector with frame for a filter unit having a flat substrate with a pattern of passages for the contact elements of the connector.

In order to surpress interference signals of higher frequency, it is advantageous in practice to use a filter unit which can be connected to the contact elements of a connector, such as is described in, for example, applicant's copending U.S. application Ser. No. 07/211,253 filed June 24, 1988 and in U.S. Pat. No. 4,791,391. granted Dec. 13, 1988 and U.S. Pat. No. 4,682,129 granted July 21, 1987, all assigned to the same assisgnee as the present application. Such a filter unit in general comprises a flat, electrically non-conducting substrate on which capacitor elements are formed. These capacitor elements are provided with passages for the connection ends of the contact elements and comprise at least one common electrode which can be connected near the ends of the substrate, and at least one electrode patch which is separated therefrom by means of a dielectric and surrounds a corresponding passage. The electrode patch is connected to the connection end of a contact element such as a terminal pin and the common electrode is connected to a shielding of electrically conducting material which encloses the contact elements of the connector. In general, this shielding is connected to the ground of an electronic circuit.

It has been found, particularly in the case of geometrically extended filter units, that the difference in coefficient of thermal expansion of the filter substrate compared to the shielding of a connector can lead to such undesirable mechanical stresses. For example, ambient temperature increases can cause the substrate or, for example, the common electrode to break.

SUMMARY OF THE INVENTION

The object of the present invention is, therefore, to improve the fittiting of the flat folter unit in a way that the mechanical stresses exerted thereon as a result of the aforenoted differences in the coefficients of thermal expansion can be absorbed in a suitable manner.

The present accomplishes this object by providing a fixing frame which has a metal base plate with a corresponding pattern of passages. The base plate is provided at two opposite edges with upright sides which each merge into guide grooves to accommodate between them the substrate in such a way that the patterns of passages coincide. The fixing frame is also provided with springloaded contact elements for contacting the housing or shielding of the connector.

Using a separate fixing frame according to the invention for fitting a filter unit in a connector has the advantage that the substrate of the filter unit can be fitted in the fixing frame in such a manner that mechanical stresses as a result of differences in the coefficients of thermal expansion of said substrate and the fixing frame can be absorbed effectively without the danger of breakage. Mechanical stresses as a result of differences in the coefficients of thermal expansion of the fixing frame and the housing or shielding of a connector are compensated for by the spring-mounted contact elements of the fixing frame.

The fixing frame according to the invention also provides for a desired mechanical reinforcement and support of the filter unit and by means of the metal base plate for an additional shielding action for magnetic interference. When the fixing frame according to the invention is used, thanks to the spring-loaded contact elements, there is no further need for the often complicated, expensive and time-consuming actions for connecting the filter unit to the housing or shielding of a connector.

Another embodiment of the filter unit according to the invention provides that the guide grooves are essentially U-shaped in cross-section, and the contact elements are spring-loaded lips which project outwards from the base side of the least one of the U-shaped grooves.

An advantageous embodiment of the invention provides that the lips are made of the same material as at least one of the upright sides of the base plate of the frame.

In those cases where the filter unit is exposed, for example, to shocks, impacts or other environmental influences, such as when used in vehicles, aircraft and the like, it may be necessary to make a firm mechanical connection of the filter unit to the fixing frame. According to yet another embodiment of the invention, mechanical stresses on the substrate of the filter unit as a result of thermal expansion are avoided in this case through the fixing frame being made of a metal with a coefficient of thermal expansion which essentially corresponds to the coefficient of thermal expansion of the substrate of the filter unit. Differences in the coefficients of thermal expansion of the fixing frame and the housing or shielding of a connector are again absorbed by the spring contact elements of the fixing frame. This embodiment of the invention is particularly suitable for use in cars in which, as is generally known, very high ambient temperatures can occur.

The invention also relates to an assembly of a fixing frame and a filter unit which has disposed on at least one edge of the substrate an electrode for contacting the filter unit. The electrode is situated on at least one edge of the substrate which is accommodated in a guide groove of the fixing frame, and is soldered to the fixing frame in the guide groove.

Such an assembly according to the invention can be fitted easily in the housing or shielding of a connector, without the need for an often complicated, time-consuming and consequently expensive soldering operation for electrically connecting the filter elements of the filter unit to the housing or the shielding of a connector. This also provides greater freedom of choice as regards the metal to be used for the housing or shielding of a connector, because material which is difficult or impossible to solder can now also be used.

The invention also relates to a connector comprising several contact elements of electrically conducting material, a housing or shielding of electrically conducting material fully or partially enclosing the contact elements, and a fixing frame with a filter unit according to the invention, the respective contact elements being electrically connected to filter elements formed on the substrate of the filter unit. The fixing frame is situated inside the housing or shielding of the connector and is connected electrically to said housing or shielding by means of its contact elements.

The mechanical reinforcement of the filter unit obtained through use of the fixing frame according to the invention makes it possible to provide a connector in which no special body of electrically insulating material for carrying and supporting the contact elements is required. Of course, the fixing frame according to the invention can also be used in connectors which are provided with such a body.

In addition to the above-mentioned breakage of the substrate of the filter electrodes as a result of mechanical stresses caused by thermal expansion, substrate expansion can also lead to damage to the protective coating sometimes applied to it as a protection against moisture, dirt and other environmental influences. The filter action can thereby be adversely affected.

The invention therefore also relates to a filter unit for connectors, in particular for use with a fixing frame according to the invention, comprising a flat substrate of electrically non-conducing material with a pattern of passages or apertures and with filter elements fitted in the region of one or more of the passages. The filter unit is covered by a protective coating of electrically insulating material, at least with the exception of the connection areas of the filter elements, characterized in that the protective coating is formed by a plastic film which is marketed under the trade name of Vacrel.

The invention is explained in greater detail below in a description of the preferred embodiment of the fixing frame and with reference to the drawing.

DETAILED DESCRIPTION OF THE EMBODIMENT

Figure 1:
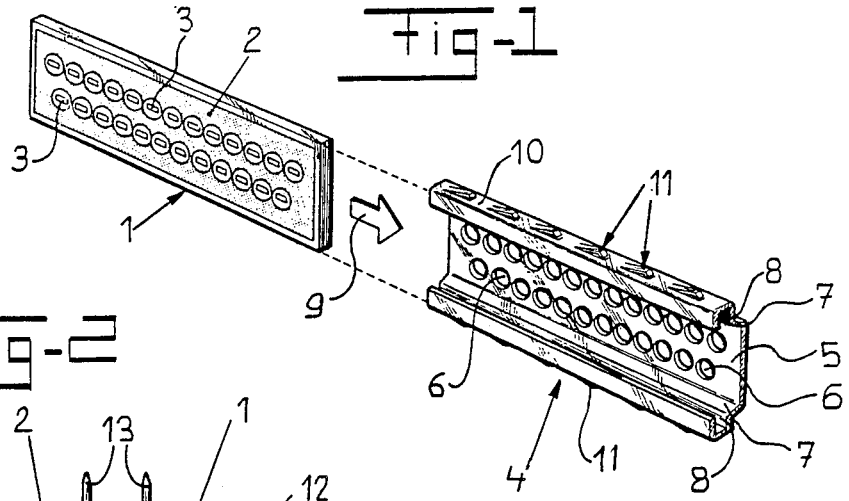
FIG. 1 shows schematically in perspective the preferred embodiment of the fixing frame according to the invention, with a flat filter unit.

FIG. 1 shows an elongated flat filter unit 1 for use in connectors. The filter elements are disposed on a substrate 2 which has two rows of passages or apertures 3 through which the contact elements of a connector can be passed.

The preferred embodiment of the fixing frame according to the invention is indicated by reference number 4. The elongated base plate 5 of this fixing frame has two rows of passages or apertures 6 which are arranged to correspond to the arrangement of the passages 3 in the substrate 2 of the filter unit 1. Two short, upright sides 7, each merging into a U-shaped groove 8, are formed on the edges of the base plate 5.

These two U-shaped grooves 8 extend at the same height as and parallel to the base plate 5. The open sides of these U-shaped grooves patch each other, for the accommodation of the flat filter unit 1 between them parallel to the base plate 5, as illustrated by the arrow 9. It will be clear that the dimensions of the U-shaped grooves 8 and the distance between them depend on the length and thickness and the width respectively of the substrate 2 of the filter unit 1. Of course, other shapes of guide grooves can also be used, for example adapted to a specific filter unit. When the filter unit 1 and the fixing frame are assembled the respective passages 3, 6 are in line with each other for passing the contact elements of a connector through them.

For contacting of the housing or shielding of a connector, provision is made on the base side 10 of each U-shaped groove 8 for outward-projecting spring-loaded lips 11 which are connected firmly by one end to the base side 10, while the other free end is bent over towards the base side 10. The lips can be formed in an advantageous manner by punching out of the material of the base side 10 itself. The fixing frame 4 can be advantageously formed as a whole from one metal sheet.

Figure 2:
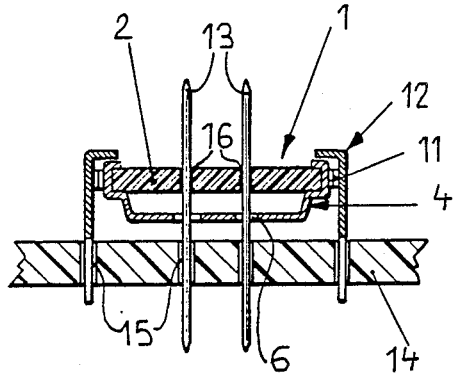
FIG. 2 shows schematically a cross section of a connector with a fixing frame and filter unit according to FIG. 1.

FIG. 2 shows schematically a cross section of the fixing frame 4, with a filter unit 1, fitted inside a metal housing 12 of a connector. The contact elements 13 of this connector are connected by one end to a printed circuit board 14 and by the other end electrically to the filter elements of the filter unit 1. The housing 12 is connected to the ground of the printed circuit board 14. Instead of the pinshaped contact elements 13 shown, contact elements in the form of insulation displacement contacts, socket contacts etc. can also be used. Moreover, instead of the fitting illustrated through passages 15 in the printed circuit board 14, both the contact elements 13 and the housing 12 can be connected to the board 14 by means of socalled surface mounting technology.

The fixing frame 4 is in electrical contact with the housing 12 of the connector by means of the spring-loaded lips 11. The passages 6 in the base plate 5 of the fixing frame are of such dimensions that the contact elements 13 do not make electrical contact with the fixing frame 4. The contact elements 13 are preferably connected by means of soldered joints 16 to the one electrode of the filter elements of the filter unit 1, of which filter elements the respective other electrodes are connected by means of the metal fixing frame 4, the spring-loaded lips 11 and the housing 12 of the connector to the signal earth of the printed circuit board 14.

In this embodiment the fixing frame 4 essentially fulfils a threefold function. First, it provides sufficient mechanical reinforcement for the substrate of the filter unit, in such a way that an additional body of electrically insulating material is not necessary for supporting the contact elements 13; secondly, the metal base plate 5 provides additional protection against undesirable magnetic interference; and thirdly, the spring-loaded lips 11 compensate for differences in the coefficients of thermal expansion between the fixing frame 4 and the housing 12, which reduces the risk of breakage of the substrate 2 of the filter unit or breakage of one or more filter elements thereof due to mechanical stresses.

The use of spring-loaded lips 11 according to the invention, which can, of course, also be other suitable spring-loaded electrical contact elements, also means that the filter elements of the filter unit 1 do not have to be connected by, for example, soldering to the housing 12 of the connector. Such a soldering process is generally rather complicated, time-consuming and counsequently relatively expensive in practice, due to the shape and available space inside the housing of a connector. It goes without saying that the spring-loaded contact elements can be limited to one U-shaped groove 8, or can, for example, be disposed on another side of the U-shaped groove.

In geometrically extended filter units in particular, for example with four rows of passages, problems can, as stated above, occur due to differences in coefficient of thermal expansion between the substrate and the fixing frame 4. Any mechanical stresses exerted on the substrate can effectively be compensated for by fitting the substrate 2 in the fixing frame with sufficient clearance or if necessary spring-loaded, for example by means of spring loaded lips facing the U-shaped grooves 8.

Through the use of a filter unit of the type mentioned in the introduction, in which the filter elements are made up of flat capacitors with one or more common electrodes which can be connected to one or more edges of the substrate and electrode patchs to which the respective contact elements of a connector are connected, the electrodes situated at one or more edges of, the substrate in the U-shaped grooves 8 can be soldered to the fixing frame 4. This produces a mechanically very stable and sturdy combination of filter unit and fixing frame, for fitting as a whole in a connector.

In order to avoid problems here as regards breakage of the substrate or one or more electrode patches or common electrodes due to thermo-mechanical stresses, the fixing frame can advantageously according to the invention be made of a material with essentially the same coefficient of thermal expansion as that of the substrate 2 of the filter unit 1. If a substrate of aluminium oxide ($Al_2O_3$) is used, the fixing frame can be made of, inter alia, Kovar.

Figure 3:
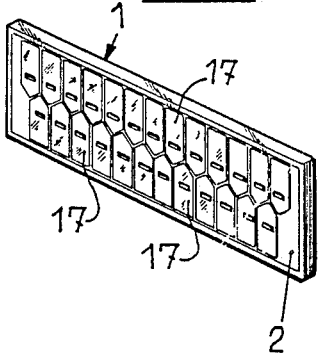
FIG. 3 shows schematically in perspective a flat filter unit.

As shown in FIG. 3, in order to protect the filter elements 17 on the substrate 2 of the filter unit 1 from the effects of moisture, chemical influences and the like, for the purpose of maintaining the desired filter properties for as long as operating time as possible, a protective coating of electrically insulating material is in practice applied to said filter elements. The connection areas for the filter elements 17 around the passages 3 and at the edges of the substrate 2 are, of course, not covered. It has, however, been found that the protective action is adversely affected due to differences in coefficient of thermal expansion between this protective coating and the substrate, and due to ageing. It has been found that a number of materials normally used in electronic equipment for the provision of such a protective action are inadequate or totally unsuitable in more extreme conditions such as, for example in automobile engineering.

In order to obtain a better seal, use is made according to the invention of a plastic film which is not yet totally polymerized, marketed under the trademark Vacrel by the assignee of the present invention as a photoresist soldermask.

When this photorisist film is applied over the filter elements 17 on one or both flat sides of the substrate, the film is treated by means of a photochemical process, using a mask, exposure with UV light and a chemical solvent, in such a way that in the area of the connections of the filter elements the plastic material is removed. If everything is subsequently subjected to a thermal process, an exceptionally resistant protective coating is obtained, and is resistant to the penetration of moisture and chemicals to the extent required in, inter alia, the automobile industry.

Figure 4:
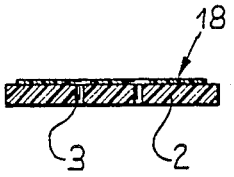
FIG. 4 shows schematically a cross section of a flat filter unit with a protective coating applied to it according to the invention.

FIG. 4 shows a cross section through a flat filter unit with a Vacrel protective coating applied thereto according to the invention.

In a filter unit in which filter elements are formed on the two flat sides of the substrate such a Vacrel photoresisit protective layer will, of course, have to be formed on both sides.

Although the invention is explained above with reference to a 35 flat filter unit with filter elements in the form of flat capacitors, it will be clear that the fixing frame in particular can also be used with the same advantages for other similar filter units.

I claim:

1. A frame for fixing a filter unit within a connector having a shielding housing and plurality of contact terminals, the filter unit having a substrate with a pattern of apertures for receiving the contact terminals of the connector, the fixing frame comprising a metal base plate having a pattern of apertures corresponding to the pattern of apertures in the filter unit substrate, said base plate being provided at opposite side edges thereof with upright sides, each said upright side having a guide groove facing one another so as to accommodate between them the substrate in such a way that the patterns of apertures in the filter unit substrate and frame coincide, the fixing frame also being provided with spring-loaded contact elements for contacting the shielding housing of the connector.

2. The fixing frame of claim 1, wherein the guide grooves are essentially U-shaped in cross section, and the spring loaded contact elements have spring-loaded lips which project outwards within at least one of the U-shaped grooves.

3. The fixing frame of claim 2, wherein the lips are made of the material of the at least one upright side of the base plate.

4. The fixing frame of claim 1, wherein the fixing frame is made of a metal with a coefficient of thermal expansion which essentially corresponds to the coefficient of thermal expansion of the substrate of the filter unit.

5. A fixing frame according to claim 4, wherein the filter unit has disposed on at least one edge of its substrate an electrode for connection of the filter unit, said electrode being positioned so as to be located in the guide groove of the fixing frame when the filter unitsubstrate is inserted into the frame, said electrode being soldered to the fixing frame in said guide groove.

6. A filter unit accommodated within a connector by a fixing frame, said filter unit comprising a substrate of electrically, insulating material having a pattern of apertures and a filter element disposed around each of said apertures, the surface of said filter unit being covered by a protective coating of electrically insulating material, except in the area of the apertures, said protective coating being formed of a photosensitive film, said pattern of apertures being adapted to receive contact terminals of a connector and the filter unit being adapted to be disposed within the connector by means of a fixing frame, said frame having a pattern of apertures corresponding to the pattern of apertures on the filter unit substrate, said fixing frame including a base plate provided at opposite side edges thereof with upright sides, each said upright side provided with a guide groove facing one another so as to accommodate between them the substrate in such a way that the patterns of apertures in the filter unit substrate and frame coincide, the fixing frame also being provided with spring-loaded contact elements for contacting a shielding means of the connector.

7. A filter connector comprising a plurality of contact terminals of electrically conducting material, shielding means of electrically conducting material at least partially surrounding the contact terminals and a frame for fixing a filter unit within the connector, the respective contact terminals being electrically connected to filter elements formed on a substrate of the filter unit, the fixing frame being disposed within the shielding means of the connector and being connected electrically to said shielding means, said filter unit having a pattern of apertures for receiving the contact terminals of the connector and the fixing frame having a pattern of apertures corresponding to the pattern of apertures in the filter unit substrate, said fixing frame including a base plate provided at opposite side edges thereof with upright sides, each said upright side provided with a guide groove facing one another so as to accommodate between them the substrate in such a way that the patterns of apertures in the filter unit substrate and frame coincide, the fixing frame also being provided with spring-loaded contact elements for contacting the shielding means of the connector.

8. The filter connector of claim 7, wherein the guide grooves are essentially U-shaped in cross section, and the spring loaded contact elements have spring-loaded lips which project outwards within at least one of the U-shaped grooves.

9. The filter connector of claim 8, wherein the lips are made of the material of the at least one upright side of the base plate.

10. The filter connector of claim 7, wherein the shielding means is the metal housing of the connector, and the fixing frame is made of a metal with a coefficient of thermal expansion which essentially corresponds to the coefficient of thermal expansion of the substrate of the filter unit.

11. The filter connector of claim 10, wherein the filter unit has disposed on at least one edge of its substrate an electrode for connection of the filter unit, said electrode being positioned so as to be located in the guide groove of the fixing frame when the filter unit substrate is inserted into the frame, said electrode being soldered to the fixing frame in said guide groove.

12. A filter connector comprising a plurality of contact terminals of electrically conductive material, a metal housing at least partially shielding said contact terminals and a frame for fixing a filter unit within the connector, the respective contact terminals being electrically connected to filter elements formed in a substrate of the filter unit, the fixing frame being disposed within and connected electrically to said metal housing, the fixing frame being made of metal with a coefficient of thermal expansion which essentially corresponds to the coefficient of thermal expansion of the substrate of the filter unit.

* * * * *